US006662837B2

(12) United States Patent
Smith

(10) Patent No.: US 6,662,837 B2
(45) Date of Patent: Dec. 16, 2003

(54) REPLACEABLE BLADES FOR WOOD CHIPPERS

(76) Inventor: Paul M. Smith, 387 N. 5th St., Timpson, TX (US) 75975

( * ) Notice: Subject to any disclaimer, the term of this patent is extended or adjusted under 35 U.S.C. 154(b) by 0 days.

(21) Appl. No.: 10/190,719

(22) Filed: Jul. 9, 2002

(65) Prior Publication Data

US 2003/0010403 A1 Jan. 16, 2003

Related U.S. Application Data

(60) Provisional application No. 60/305,941, filed on Jul. 16, 2001.

(51) Int. Cl.[7] ..... B27C 1/00; B27C 5/00

(52) U.S. Cl. ..... 144/241; 144/176; 144/220; 144/162.1; 144/218; 144/230; 241/92; 241/296; 407/49

(58) Field of Search ..... 144/162.1, 172, 144/174, 176, 218, 220, 230, 241; 241/92, 296; 407/42, 45, 49, 54, 112

(56) References Cited

U.S. PATENT DOCUMENTS 3,570,567 A * 3/1971 Hickman ..... 144/220
3,777,793 A * 12/1973 Miller ..... 144/220
4,082,127 A * 4/1978 Miller ..... 407/49 X
4,444,233 A * 4/1984 Miller ..... 144/220
5,511,597 A 4/1996 Shantie et al. ..... 144/220
5,819,826 A 10/1998 Schmatjen ..... 144/241
5,820,042 A 10/1998 Robison ..... 241/92
RE36,659 E 4/2000 Toogood ..... 144/220

* cited by examiner

*Primary Examiner*—W. Donald Bray
(74) *Attorney, Agent, or Firm*—John M. Harrison

(57) ABSTRACT

Single-edged wood chipper blades which can be repeatedly removed from a wood chipper and sharpened, as needed, to prevent the need for disposing of multiple conventional blades over a prolonged period of repeated use. Each of the replaceable blades typically includes a blade mount base for engaging a rotary chipping head of the chipper, a clamp plate for engaging the blade mount base, and a blade body interposed between the blade mount base and the clamp plate. A blade edge is shaped in the front end of the blade body, and extends from between the blade mount base and the clamp plate. A blade babbitt is provided in the rear end of the blade body. Accordingly, the blade body can easily and repeatedly be removed from between the blade mount base and the clamp plate and sharpened, and again secured in place between the blade mount base and the clamp plate, as needed for optimum and economical operation of the chipper over a prolonged period.

13 Claims, 5 Drawing Sheets

REPLACEABLE BLADES FOR WOOD CHIPPERS

CROSS REFERENCE TO RELATED APPLICATIONS

This application claims the benefit of prior filed copending U.S. Provisional Patent Application Serial No. 60/305,941, Filed Jul. 16, 2001.

BACKGROUND OF THE INVENTION

Field of the Invention

This invention relates to wood chippers such as log slabbers and canters, and more particularly, to single-edged wood chipper blades which can be repeatedly removed from a wood chipper and sharpened, as needed, to prevent the need for disposing of multiple conventional blades over a prolonged period of repeated use. Each of the replaceable blades typically includes a blade mount base for engaging a rotary chipping head of the chipper, a clamp plate for engaging the blade mount base, and a blade body interposed between the blade mount base and the clamp plate. A blade edge is shaped in the front end of the blade body, and extends from between the blade mount base and the clamp plate. A blade babbitt is provided in the rear end of the blade body. Accordingly, the blade body can easily and repeatedly be removed from between the blade mount base and the clamp plate and sharpened, and again secured in place between the blade mount base and the clamp plate, as needed for optimum and economical operation of the chipper over a prolonged period.

Wood chippers such as log slabbers or canters typically include a pair of spaced-apart, power-rotated chipping heads each having multiple, inwardly-facing, double-edged blades mounted on the respective chipping heads. In operation of the chipper, the cutting edges of the blades are rotated in a circular path against the respective sides of a log as the log is longitudinally advanced between the rotating chipping heads. Accordingly, the blades of the chipping heads cut chips off the respective sides of the log to form planar longitudinal cuts in the log and generate wooden chips which can be used for various applications such as landscaping. Over a prolonged period of repeated uses, the dulled, conventional double-edged blades are typically removed from the chipping heads and, instead of being sharpened and replaced on the chipping heads, are discarded and replaced with fresh blades. Because each of the blades is expensive, discarding and replacement of the blades over time results in substantial costs to the chipper operator.

Various blades and blade-mounting techniques for wood chippers are known in the art. Typical of these are the blades detailed in the following patents: U.S. Pat. No. 5,511,597, dated Apr. 30, 1996, to Shantie, et al., describes a "Slabbing Chipper with Replaceable Knives and Wear Plate"; U.S. Pat. No. 5,819,826, dated Oct. 13, 1998, to Schmatjen, details a "Chip Cutting Knife with Spaced Deflector Ridges"; U.S. Pat. No. 5,820,042, dated Oct. 13, 1998, to Robison, discloses a "Wood Chipper Rotor Head Knife Holder and Knife Assembly"; and U.S. Pat. No. Re36,659, dated Apr. 18, 2000, to Toogood, describes a "Chipper with Detachable Facing Knives".

An object of the present invention is to provide replaceable blades for wood chippers, which replaceable blades facilitate efficient and economical operation of wood chippers.

Another object of this invention is to provide replaceable blades for a variety of different types of wood chippers, including slabbers, canters and brush chippers.

Still another object of this invention is to provide replaceable blades for wood chippers, which replaceable blades can be removed from a wood chipper, sharpened and replaced on the chipper to avoid excessive disposal of chipper blades.

Yet another object of this invention is to provide replaceable blades for a variety of different types of wood chippers, which replaceable blades can be constructed in any desired size.

A still further object of this invention is to provide replaceable blades for wood chippers, typically including a blade mount base for engaging a rotary chipping head of the chipper; a clamp plate for engaging the blade mount base; a blade body interposed between the blade mount base and the clamp plate, which blade body includes a blade edge shaped in the front end of the blade body and extending from between the blade mount base and the clamp plate, and a blade babbitt provided in the rear end of the blade body.

SUMMARY OF THE INVENTION

These and other objects of the invention are provided in single-edged blades which can be removed, sharpened and replaced on wood chippers to prevent the need for disposing of multiple, conventional blades over a prolonged period of multiple uses. The replaceable blades of this invention typically include a blade mount base for engaging a rotary chipping head of the chipper, a clamp plate for engaging the blade mount base, and a blade body interposed between the blade mount base and the clamp plate. A blade edge is shaped in the front end of the blade body, and extends beyond the blade mount base and the clamp plate. A blade babbitt is provided in the rear end of the blade body. Accordingly, the blade body can easily and repeatedly be removed from between the blade mount base and the clamp plate and sharpened, and again secured in place between the blade mount base and the clamp plate, as needed for optimum and economical operation of the chipper over a prolonged period of multiple uses.

BRIEF DESCRIPTION OF THE DRAWINGS

The invention will be better understood by reference to the accompanying drawings, wherein.

DESCRIPTION OF THE PREFERRED EMBODIMENTS

Figure 7:
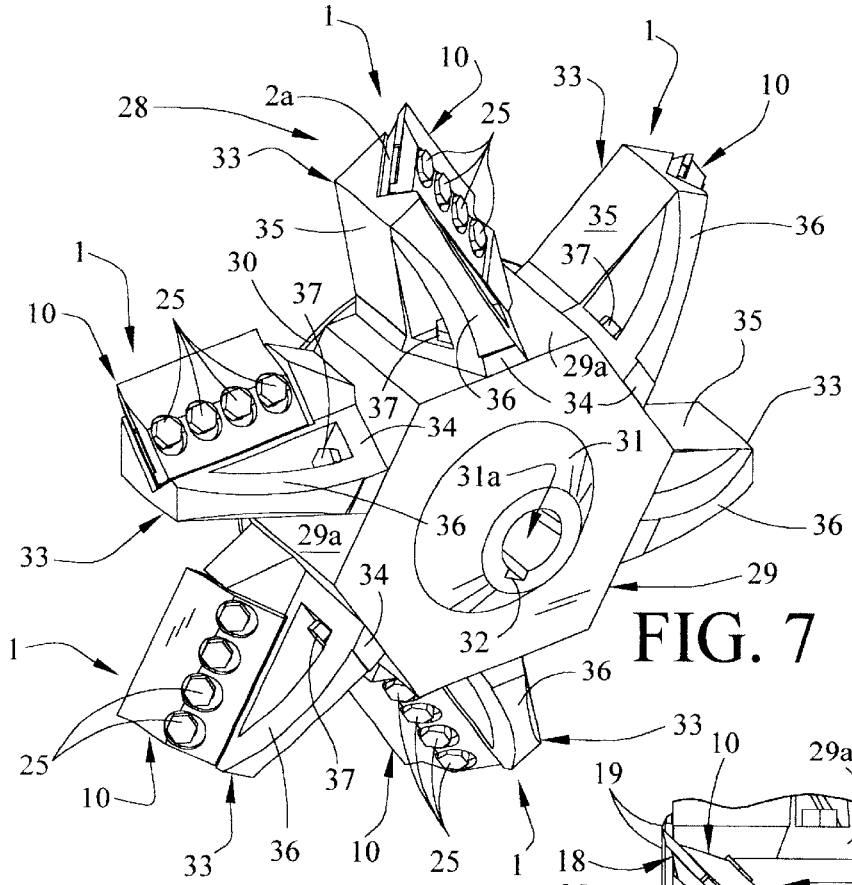
FIG. 7 is a perspective view of a chipping head element of a log chipper, with multiple replaceable blades of this invention mounted on the chipping head.
Figure 9:
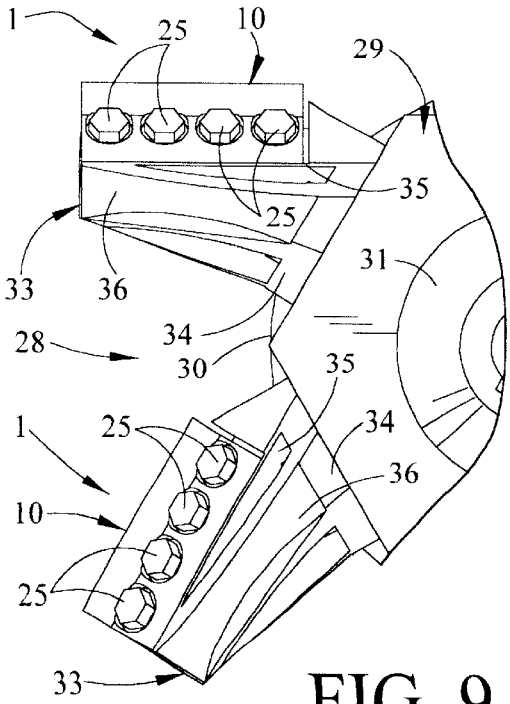
FIG. 9 is a front view, partially in section, of the chipping head illustrated in FIG. 7.
Figure 8:
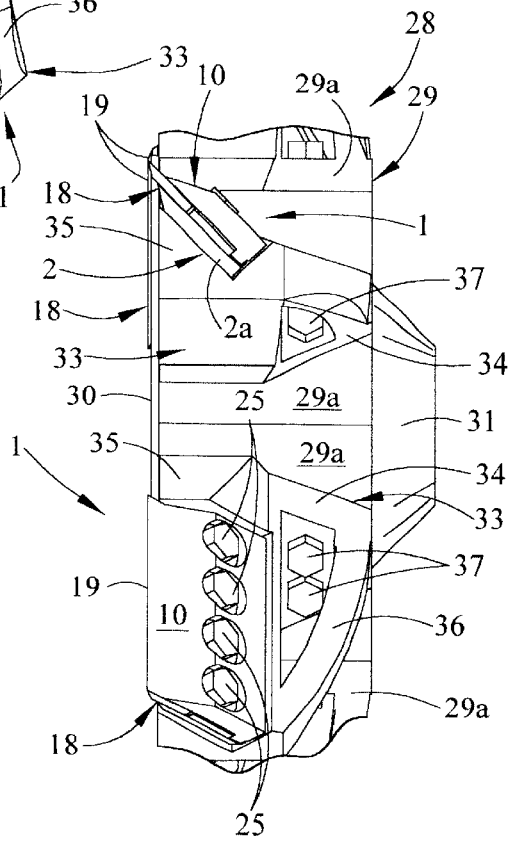
FIG. 8 is a side view, partially in section, of the chipping head illustrated in FIG. 7.
Figure 10:
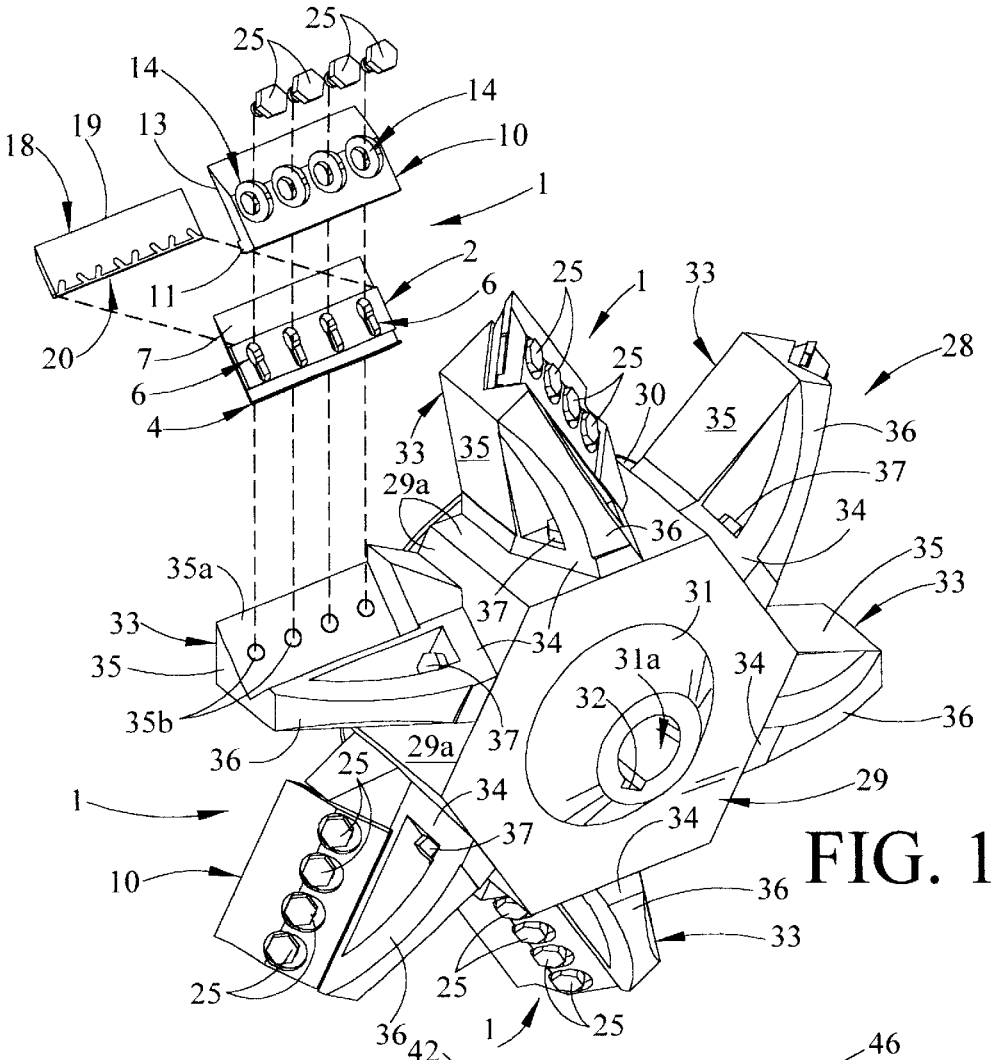
FIG. 10 is an exploded, perspective view of the replaceable blades of this invention, more particularly illustrating a typical bolt technique for removably mounting the replaceable blades on the chipping head.

Referring initially to FIGS. 7–10 of the drawings, in an illustrative embodiment the replaceable blades for wood chippers, hereinafter referred to as the replaceable blades, of this invention are each generally illustrated by reference numeral 1. In typical application, multiple replaceable blades 1 are mounted on each of a pair of chipping heads 28 in a conventional log slabber or cantor (not illustrated), one of which chipping heads 28 is illustrated in FIGS. 7–10. The chipping heads 28 are disposed in spaced-apart relationship with respect to each other on respective rotor head drive shafts (not illustrated), and in operation of the log slabber or canter, a log carriage (not illustrated) advances a log (not illustrated) between the chipping heads 28 in a direction transverse to the rotational axis of the chipping heads 28, which cut wood chips from the respective side margins of the log that overlap the cutting plane of the chipping heads 28. Each chipping head 28 typically includes a rotor head 29, fitted with a circular face plate 30 on the inside face thereof, which face plate 30 abuts against the corresponding side of the log as the log is cut by the rotating chipping head 28. A shaft hub 31 is typically provided on the opposite, outside face of the rotor head 29, and a key slot 32 located inside a shaft bore 31*a* which extends centrally through the shaft hub 31 and the rotor head 29 facilitates keyed attachment of the rotor head 29 to the rotor head drive shaft (not illustrated), extending through the shaft bore 31*a,* in conventional fashion. The rotor head 29 illustrated in FIGS. 7–9 is shaped in the configuration of a hexagon and includes six rotor faces 29*a* of substantially equal size, although the rotor head 29 may include three, four, or eight or more of the rotor faces 29*a,* depending upon the application of the log slabber or cantor. Elongated holders 33 extend outwardly from the respective rotor faces 29*a* of the rotor head 29, and each includes a holder base 34 attached to the corresponding rotor face 29*a* typically by means of holder mount bolts 37; a blade mount portion 35 extending from the holder base 34; and an angled bracing portion 36 connecting the holder base 34 to the blade mount portion 35 of the holder 33. As illustrated in FIG. 10, the blade mount portion 35 of each holder 33 is typically triangular in cross-section and is provided with a sloped blade mount surface 35*a,* through which extend multiple mount bolt openings 35*b* which receive respective blade mount bolts 25 that mount the replaceable blade 1 on the corresponding blade mount surface 35*a*, as hereinafter described. (FIG. 10)

Figure 1:
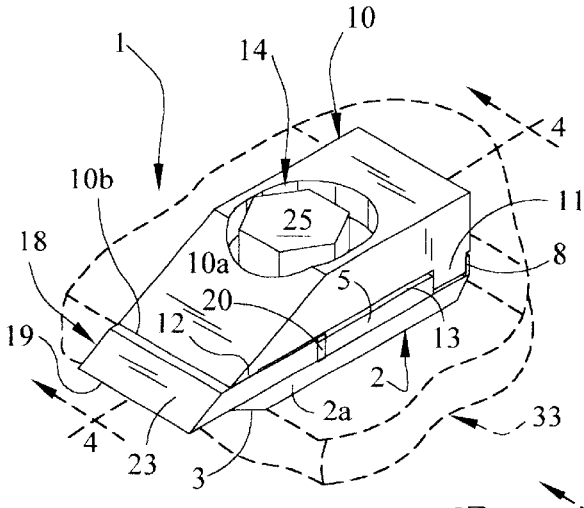
FIG. 1 is a top perspective view of an illustrative embodiment of a replaceable blade for wood chippers of this invention, mounted on a wood chipper (in phantom)
Figure 2:
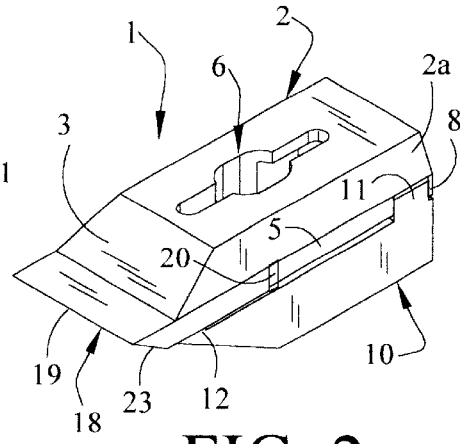
FIG. 2 is a bottom perspective view of the replaceable blade illustrated in FIG. 1.
Figure 3:
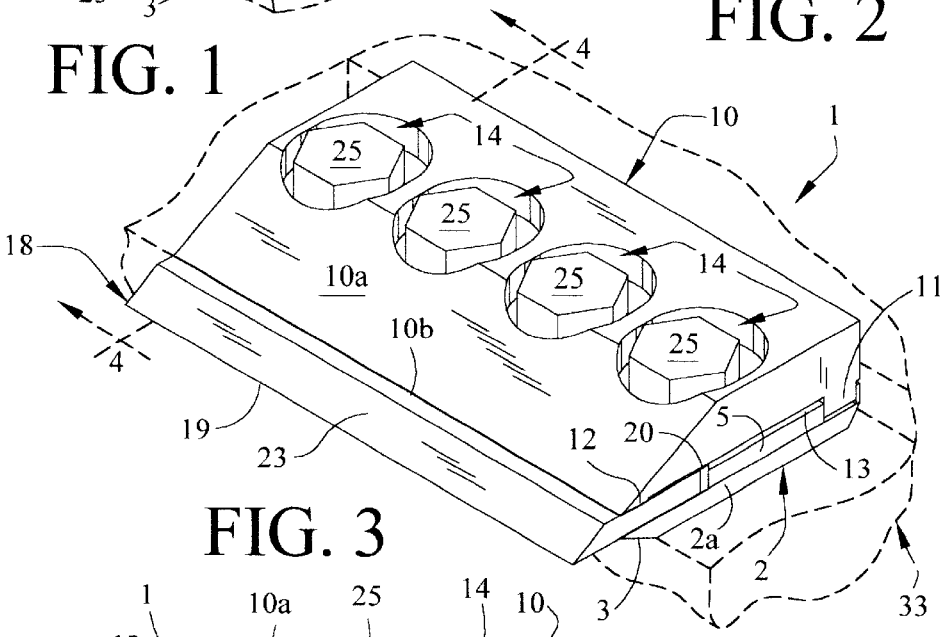
FIG. 3 is a top perspective view of an elongated embodiment of the replaceable blades for wood chippers.
Figure 4:
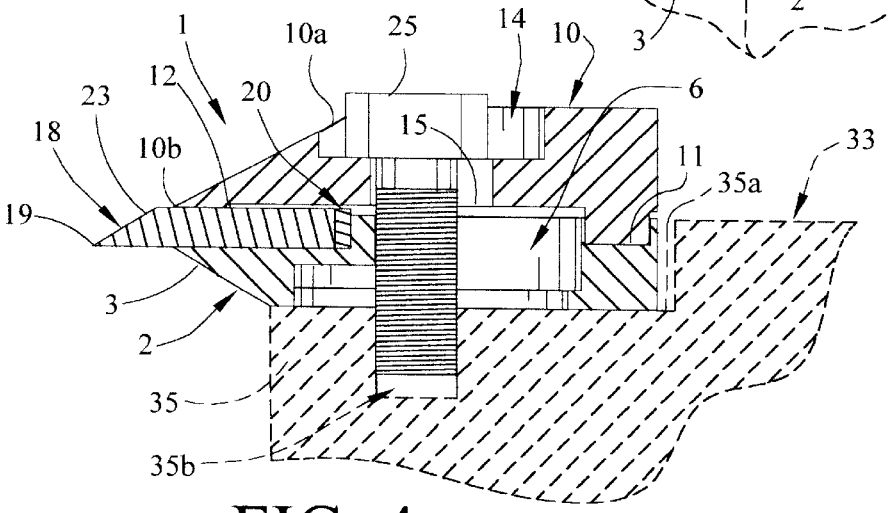
FIG. 4 is a transverse sectional view, taken along section line 4—4 in FIG. 3, of a replaceable blade for wood chippers, illustrating a typical bolt technique for removably mounting the blade to a chipper.
Figure 5:
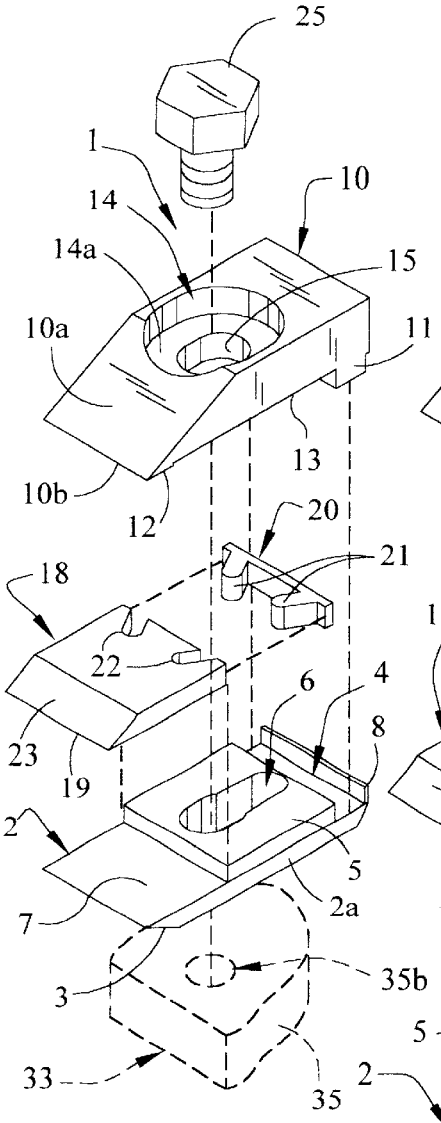
FIG. 5 is an exploded, perspective view of the replaceable blade illustrated in FIG. 1.
Figure 6:
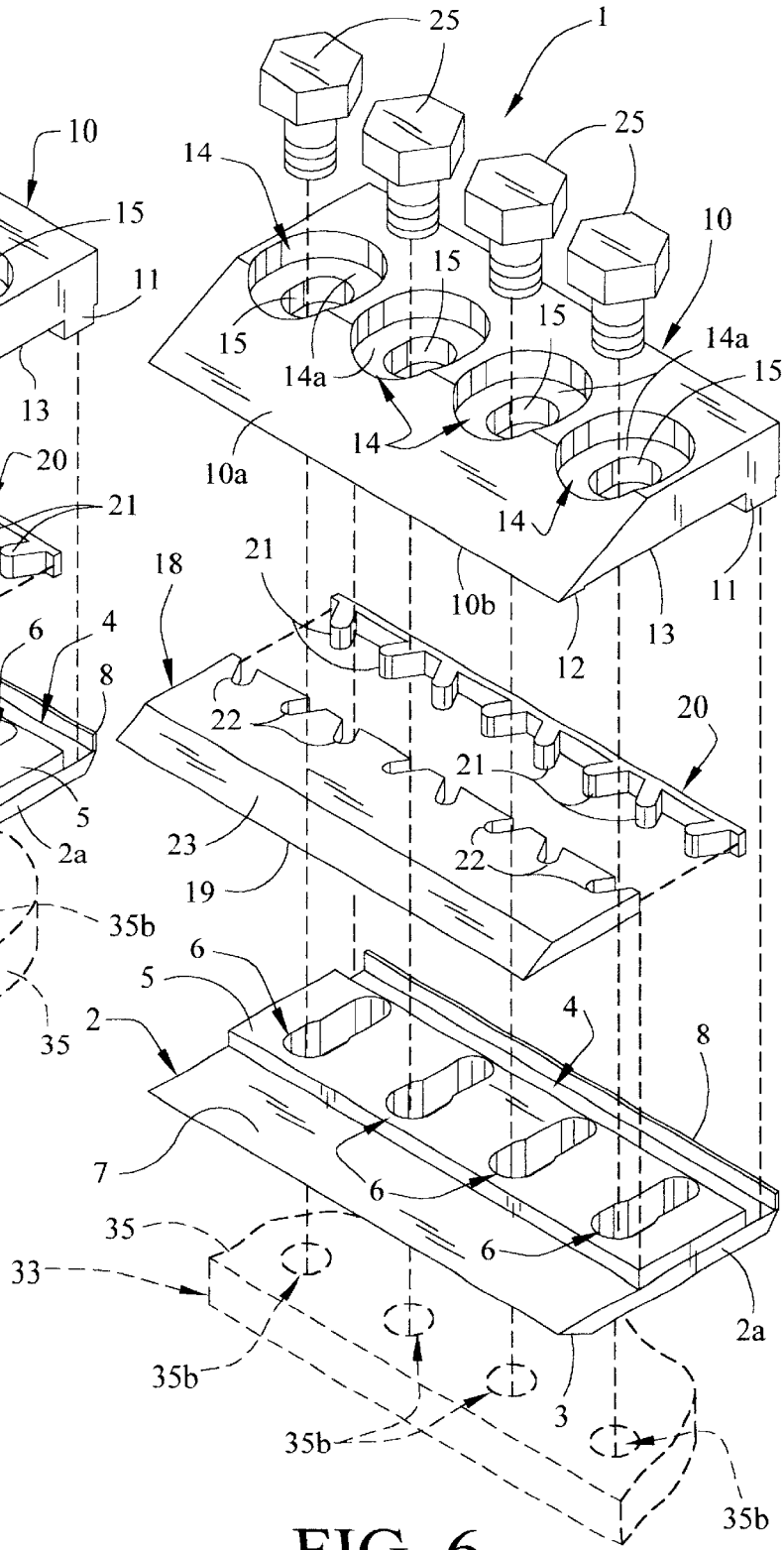
FIG. 6 is an exploded, perspective view of the replaceable blade illustrated in FIG. 3.

Referring next to FIGS. 1–6 of the drawings, the replaceable blades 1 of this invention can be any desired length depending on the application, wherein a short replaceable blade 1 is shown in FIGS. 1, 2 and 5 and a longer replaceable blade 1 is shown in FIGS. 3 and 6. Each replaceable blade 1 includes a blade mount base 2, having a substantially rectangular base plate 2*a,* the bottom surface of which is typically provided with a base bevel 3 at the front end thereof. As particularly illustrated in FIGS. 5 and 6, a rectangular base block 5 is mounted on or formed integrally with the upper surface of the base plate 2*a*, the rear end of which base block 5, in combination with an elongated base flange 8 extending upwardly from the rear edge of the base plate 2*a*, defines a base channel 4, typically having a substantially rectangular cross-sectional configuration. The upper surface of the base plate 2*a* further defines a blade seat 7 between the front end of the base block 5 and the bevel 3 end of the base plate 2*a*. An elongated base slot 6 extends through the base block 5 and the base plate 2*a* of the blade mount base 2, for purposes hereinafter described. In the case of the longer replaceable blades 1, multiple base slots 6 are typically provided in the blade mount base 2, as illustrated in FIG. 6, the number of base slots 6 depending upon the length of the replaceable blade 1. A blade body 18, having a blade bevel 23 and a blade edge 19 shaped along the front end thereof, is provided with multiple spline notches 22 spaced along the rear end of the blade body 18 for receiving respective babbitt splines 21 of a blade babbitt 20. A clamp plate 10 of the replaceable blade 1 is mounted on the blade mount base 2 to secure the blade body 18 on the blade mount base 2, as hereinafter described. A plate bevel 10*a*, having a bevel edge 10*b*, is typically shaped in the top surface of the clamp plate 10, at the front end thereof, and a clamp plate lip 12 is typically shaped in the bottom surface of the clamp plate 10, adjacent to the bevel edge 10*b*. The clamp plate 10 is typically further provided with a clamp plate flange 11 which extends downwardly from the bottom surface 13 of the clamp plate 10, adjacent to the rear end thereof, which clamp plate flange 11 typically has a rectangular cross-section and fits in the companion base channel 4 of the blade mount base 2, as hereinafter described. The upper portion of each of one or multiple bolt openings 15 extending through the clamp plate 10 is typically flared outwardly to form a bolt seat 14 defining a bolt shoulder 14*a*. The bolt opening or openings 15 of the clamp plate 10 match in number the base slot or slots 6, respectively, of the blade mount base 2.

Referring again to FIGS. 1–8 and FIG. 10 of the drawings, in application the replaceable blades 1 are initially removably attached to the respective holders 33 (FIG. 10) of each chipping head 28 by means of one or multiple blade mount bolts 25. Accordingly, as illustrated in FIG. 10, the blade mount base 2 is initially positioned on the sloped blade mount surface 35*a* of the holder 33, with the base bevel 3 of the blade mount base 2 overhanging the upper edge of the blade mount surface 35*a*, as illustrated in FIG. 4, and the base slot or slots 6 of the blade mount base 2 registering with the respective mount bolt opening or openings 35*b* of the holder 33, as illustrated in FIGS. 5, 6 and 10. The blade body 18 is then positioned on the blade seat 7 of the blade mount base 2, with the blade babbitt 20 typically in contact with or adjacent to the front end of the base block 5 and the blade bevel 23 and blade edge 19 of the blade body 18 extending beyond the front end of the blade mount base 2, as further illustrated in FIG. 4. Finally, the clamp plate 10 is rested on the blade mount base 2, with the bottom surface 13 of the clamp plate 10 disposed slightly above the base block 5 of the blade mount base 2, the clamp plate lip 12 of the clamp plate 10 resting on the blade body 18 and the clamp plate flange 11 of the clamp plate 10 seated in the companion base channel 4 of the blade mount base 2. Each of one or multiple blade mount bolts 25, as required, are then extended downwardly through the respective bolt opening or openings 15 of the clamp plate 10 and the respective registering base slot or slots 6 of the blade mount base 2, and threaded into the respective mount bolt opening or openings 35*b* in the blade mount portion 35 of the corresponding holder 33, as illustrated in FIG. 4. Accordingly, as illustrated in FIG. 8, the blade edge 19 of each blade body 18 protrudes beyond the face plate 30 on the rotor head 29, to define a circular cutting plane of each chipping head 28 upon rotation of the chipping head 28. As the chipping head 28 is rotated in the clockwise direction in FIG. 7, the blade edges 19 on the respective blade bodies 18 of the replaceable blades 1 on each chipping head 28 contact the side of a log (not illustrated) advanced between the adjacent chipping heads 28, and cut wood chips from the corresponding side of the log as each chipping head 28 cuts a plane in the corresponding side of the log, in conventional fashion. After a prolonged period of operation of the log slabber or canter, the blade edge 19 on the blade body 18 of each replaceable blade 1 becomes dull and the cutting quality and efficiency of the chipping heads 28 decreases. Accordingly, the blade body 18 can be removed from the corresponding replaceable blade 1 and the blade edge 19 thereof sharpened using conventional methods in the art. Removal of the blade body 18 is accomplished by unthreading the blade mount bolt or bolts 25 from the respective mount bolt opening or openings 35*b* of the holder 33 and removing the blade mount bolt or bolts 25 from the base slot or slots 6 of the blade mount base 2 and the registering bolt opening or openings 15 of the clamp plate 10; lifting the clamp plate 10 from the blade mount base 2; removing the blade body 18 from the blade seat 7 of the blade mount base 2; sharpening the blade edge 19 of the blade body 18; and re-assembling the replaceable blade 1 by means of the blade mount bolt or bolts 25, as heretofore described. It will be appreciated by those skilled in the art that the blade edge 19 of the blade body 18 can be sharpened multiple times until the blade bevel 23 and blade edge 19 encroach upon the area immediately adjacent to the spline notches 22 spaced along the rear edge of the blade body 18, at which point the blade body 18 is discarded and another blade body 18 is replaced in the replaceable blade 1.

Figure 11:
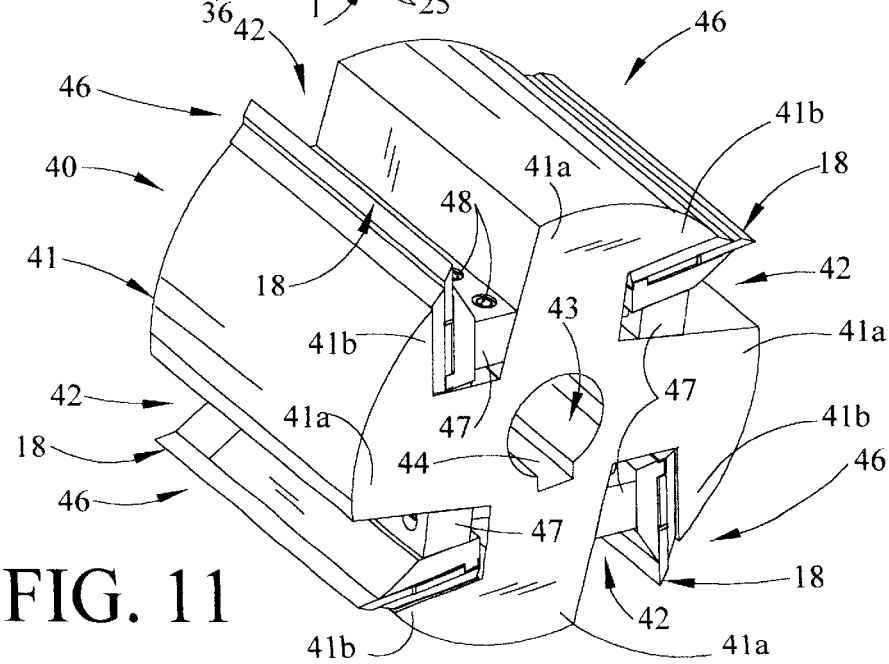
FIG. 11 is a perspective view of a chipping head for a brush chipper, with the replaceable blades of this invention mounted on the chipping head.
Figure 12:
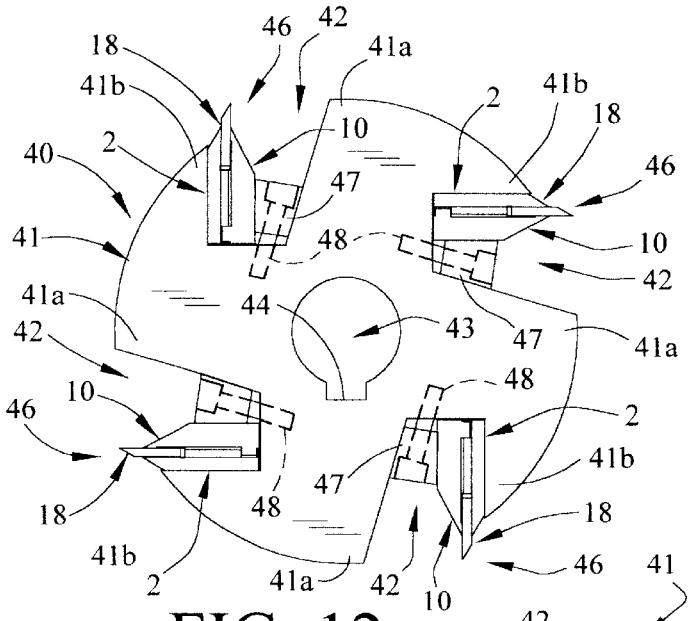
FIG. 12 is an end view of the brush chipper-type chipping head illustrated in FIG. 11.
Figure 13:
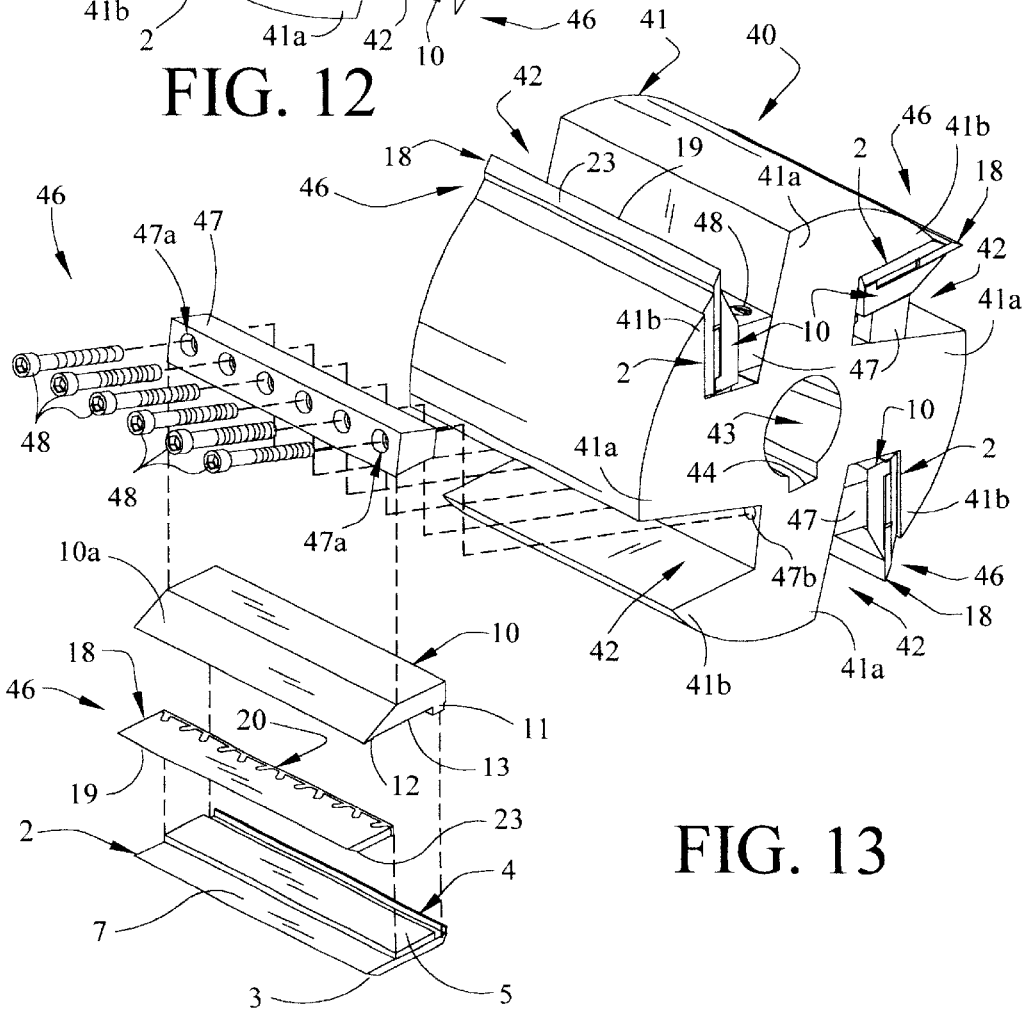
FIG. 13 is an exploded, perspective view of the brush chipper-type chipping head, illustrating a typical wedge technique for mounting the replaceable blades on the chipping head.

Referring next to FIGS. 11–13 of the drawings, in another embodiment the replaceable blades, each generally illustrated by reference numeral 46, are adapted for attachment to a conventional chipping head 40 for a brush chipper system (not illustrated). Such a chipping head 40 typically includes a generally cylindrical rotor head 41, provided with multiple, longitudinal blade mount channels 42 which define a rotor head body 41*a* on one side of each blade mount channel 42 and a rotor head arm 41*b* on the opposite side of each blade mount channel 42. The rotor head 41 is traversed by a central shaft bore 43 which includes a key slot 44 for attaching the rotor head 41 to a rotor head drive shaft (not illustrated). As illustrated in FIG. 13, each replaceable blade 46 typically includes a blade mount base 2, similar in construction to the blade mount base 2 described above with respect to the replaceable blades 1 illustrated in FIGS. 1–10, but typically lacking the elliptical base slot or slots 6 (FIG. 6). The blade body 18 of the replaceable blade 46 is substantially the same in construction to the blade body 18 of the replaceable blades 1, having the blade bevel 23, blade edge 19 and blade babbitt 20. The clamp plate 10 is similar in construction to the clamp plate 10 of the replaceable blades 1, but typically lacks the bolt opening or openings 15 (FIG. 6) and corresponding bolt seat or seats 14. As particularly illustrated in FIG. 12, each replaceable blade 46 is held in place in the corresponding blade mount channel 42 by means of an elongated wedge 47, with the blade mount base 2, blade body 18 and clamp plate 10 elements of the replaceable blade 46 interposed between the rotor head arm 41*b* and the wedge 47, and the wedge 47 interposed between the clamp plate 10 and the rotor head body 41*a*. Accordingly, as illustrated in FIG. 13, the bottom surface of the blade mount base 2 of the replaceable blade 46 engages the corresponding rotor head arm 41*b* of the rotor head 41, while the upper surface of the clamp plate 10 engages one side of the wedge 47, and the opposite surface of the wedge 47 engages the corresponding rotor head body 41*a*. The blade body 18 is interposed between the clamp plate lip 12 of the clamp plate 10 and the blade seat 7 of the blade mount base 2, as heretofore described with respect to the replaceable blades 1 of FIGS. 1–10, with the blade edge 19 and blade bevel 23 of each blade body 18 extending beyond the outer curvature of the rotor head 41, as particularly illustrated in FIG. 12. As further illustrated in FIG. 13, the wedge 47 is mounted in the corresponding blade mount channel 42 by means of multiple wedge mount bolts 48, extended through respective bolt openings 47*a* provided in the wedge 47, and threaded into respective threaded bolt openings 47*b*, provided in the rotor head 41 at the bottom of each blade mount channel 42. In use, as the chipping head 40 is rotated under power applied to the rotor head drive shaft (not illustrated) in the clockwise direction in FIG. 12, the blade edges 19 of the respective replaceable blades 46 alternately and repeatedly contact sticks, limbs or brush (not illustrated) fed into the brush chipper and cut wood chips from the sticks, limbs or brush, in conventional fashion. Removal of the blade body 18 from the replaceable blade 46 is facilitated as needed, for sharpening as heretofore described, by unthreading the wedge mount bolts 48 from the respective bolt openings 47*a* of the wedge 47; removing the wedge 47 from the blade mount channel 42; and removing the blade body 18 from between the blade mount base 2 and the clamp plate 10 for sharpening. The sharpened blade body 18 is replaced on the rotor head 41 by re-positioning the blade body 18 between the blade mount base 2 and the clamp plate 10 and again securing the wedge 47 in the blade mount channels 42 by means of the wedge mount bolts 48.

It will be appreciated by those skilled in the art that the replaceable blades of this invention facilitate tremendous savings in costs associated with operating various types of wood chippers, by enabling each blade to be sharpened and re-used multiple times without the necessity of discarding of the blade after it becomes dull through multiple usages. It will be further appreciated by those skilled in the art that the replaceable blades are capable of use on a variety of wood chippers of various design, including but not limited to log slabbers, canters, brush chippers and chip-n-saws.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. Replaceable blades for wood chippers having a chipping head, said replaceable blades each comprising:

a blade mount base for engaging the chipping head and a bolt slot provided in said blade mount base;

a clamp plate for engaging said blade mount base and a bolt opening provided in said clamp plate;

a blade body interposed between said blade mount base and said clamp plate, said blade body having a front end, a rear end spaced from said front end, a blade edge shaped in said front end and a blade babbitt provided in said rear end; and a blade mount bolt extending through said bolt opening and said bolt slot for securing said blade body between said blade mount base and said clamp plate.

2. The replaceable blades of claim 1 comprising a clamp plate flange provided on said clamp plate and a base channel provided in said blade mount base for receiving said clamp plate flange.

3. The replaceable blades of claim 2 wherein said clamp plate flange and said base channel each has a substantially rectangular cross-sectional configuration.

4. Replaceable blades for wood chippers having a chipping head, said replaceable blades each comprising:

a blade mount base for engaging the chipping head;

a clamp plate for engaging said blade mount base, said clamp plate having a clamp plate lip;

a blade body interposed between said blade mount base and said clamp plate lip of said clamp plate, said blade body having a front end, a rear end spaced from said front end, a blade edge shaped in said front end and a blade babbitt provided in said rear end; and a fastening mechanism engaging said clamp plate for securing said blade body between said blade mount base and said clamp plate.

5. The replaceable blades of claim 4 comprising a bolt opening provided in said clamp plate and a bolt slot provided in said blade mount base, and wherein said fastening mechanism comprises a blade mount bolt extending through said bolt opening and said bolt slot, respectively.

6. The replaceable blades of claim 4 comprising a clamp plate flange provided on said clamp plate and a base channel provided in said blade mount base for receiving said clamp plate flange.

7. The replaceable blades of claim 6 comprising a bolt opening provided in said clamp plate and a bolt slot provided in said blade mount base, and wherein said fastening mechanism comprises a blade mount bolt extending through said bolt opening and said bolt slot, respectively.

8. The replaceable blades of claim 6 wherein said clamp plate flange and said base channel each has a substantially rectangular cross-sectional configuration.

9. The replaceable blades of claim 8 comprising a bolt opening provided in said clamp plate and a bolt slot provided in said blade mount base, and wherein said fastening mechanism comprises a blade mount bolt extending through said bolt opening and said bolt slot, respectively.

10. Replaceable blades for wood chippers having a chipping head and a plurality of blade mount channels provided in said chipping head, said replaceable blades each comprising:

a blade mount base for engaging the chipping head and a base channel provided in said blade mount base;

a clamp plate for engaging said blade mount base and a clamp plate flange provided on said clamp plate for engaging said base channel in said blade mount base;

a blade body interposed between said blade mount base and said clamp plate, said blade body having a front end, a rear end spaced from said front end, a blade edge shaped in said front end and a blade babbitt provided in said rear end; and a wedge interposed between said clamp plate and the chipper head in the blade mount channels, respectively, for securing said blade body between said blade mount base and said clamp plate.

11. The replaceable blades of claim 10 comprising a clamp plate lip provided on said clamp plate for engaging said blade body.

12. The replaceable blades of claim 10 wherein said clamp plate flange and said base channel each has a substantially rectangular cross-sectional configuration.

13. The replaceable blades of claim 12 comprising a clamp plate lip provided on said clamp plate for engaging said blade body.

* * * * *